US005447002A

United States Patent [19]

Wehrmann

[11] Patent Number: 5,447,002

[45] Date of Patent: Sep. 5, 1995

[54] CLEAN ROOM WALL SYSTEM

[75] Inventor: Gary Wehrmann, San Antonio, Tex.

[73] Assignee: Sony Electronics Inc.

[21] Appl. No.: 105,785

[22] Filed: Aug. 12, 1993

[51] Int. Cl.[6] ..... E04B 2/78

[52] U.S. Cl. ..... 52/239; 52/126.4; 52/127.7; 52/282.4

[58] Field of Search ..... 52/238.1, 239, 282.1, 52/282.4, 582.1, 586.1, 127.5, 127.6, 127.7, 127.8, 126.3, 126.4; 160/135, 351; 454/187

[56] References Cited

U.S. PATENT DOCUMENTS

| | | | |
|---|---|---|---|
| 3,233,379 | 2/1966 | Zagray | 52/282.1 |
| 3,871,153 | 3/1975 | Birum, Jr. | 52/239 X |
| 3,999,353 | 12/1976 | Dielman | 52/239 X |
| 4,667,450 | 5/1987 | Stefink et al. | 52/238.1 X |
| 5,069,263 | 12/1991 | Edwards | 160/135 |

*Primary Examiner*—Carl D. Friedman

*Assistant Examiner*—Kien T. Nguyen

*Attorney, Agent, or Firm*—Peter C. Toto; Jerry A. Miller

[57] ABSTRACT

A device for preventing contamination of a clean room during the performance of unclean work. Wall members are provided to be connected in series, to surround and isolate the unclean work. Each wall member includes an interlocking receiving channel that can be slipped over the frame member of an adjacent wall member. This allows the wall members to be connected in series. Each wall member also has wedging means that allows the wall member to be tightly wedged between the ceiling and floor of the clean room, to prevent contaminants produced by unclean work from traveling from the work area to the rest of the clean room. If the unclean work includes making an opening in the wall of the clean room, a similar arrangement can be constructed on the opposite side of the wall, if that area also needs to be kept clean.

1 Claim, 3 Drawing Sheets

CLEAN ROOM WALL SYSTEM

BACKGROUND

1. Field of the Invention

The present invention relates to portable wall members that can be put together to surround maintenance or construction work in an enclosed room. More particularly, it relates to portable wall members which are to be installed to separate an area of a clean room or sanitized room where maintenance or construction work is taking place from the other portions of the room, to prevent contaminants from traveling from the separated area to the rest of the room.

2. Background of the Invention

Facilities such as clean rooms for the manufacture of semiconductors, where the dust particle count has to be kept below a certain level, and hospital operating rooms, have to kept as free of dust and debris particles as possible. This makes walls that can be used in a clean area either expensive, difficult to install, or both. Additionally, modifications or maintenance work in a clean area, particularly modification of a permanent wall, such as drilling holes, can generate a high dust and debris particles count. This can rapidly exceed the allowable level for clean room contaminants and disrupt normal function.

Previously, to separate unclean work from the clean room, a unibody temporary wall, constructed of polyethylene film, conduit, and a unistrut steel channel, was used to enclose the unclean work and to shield the clean room from unclean work. This structure has been found to be less than satisfactory, creating a long felt but unsatisfied need in the industry for a better structure. The structure proved inadequate because setting up the structure, particularly joining the heavy steel channel and the soft polyethylene film, is difficult and labor intensive. Furthermore, the film has a tendency to bulge and collapse and this contaminates the clean room and disrupts work. The film bulges and collapses because the air pressure in the enclosed chamber is lower than air pressure in the rest of the clean room. The pressure difference is created because the air pressure in a clean room is kept above atmospheric pressure to insure that in case of a leak, or an opening, clean air from the clean room exits the clean room instead of allowing contaminated air from outside of the clean room to enter. When the unclean work involves creating an opening in a wall of the clean room there is usually some pressure difference on the two sides of the opening, the air on the side of the opening outside the clean room is at a lower pressure than the air on the clean room side of the opening. Because of the opening, the air pressure on the clean room side of the opening begins to drop due to air passing through the opening, and the air in the area enclosed by the temporary wall drops below the air pressure in the rest of the clean room.

In "Clean Room Tool Chamber" U.S. Pat. application Ser. No. 07/936,826, filing date Aug. 28, 1992, and assigned to the assignee of the present invention, incorporated herein by reference, a box-like containment chamber for surrounding a power driven tool to facilitate the use of the power driven tool in a clean room is disclosed.

SUMMARY OF THE INVENTION

It is an object of the present invention to provide a device for performing unclean work, including performing maintenance, or making holes or cuts in a wall of a clean room or hospital room, without contaminating the clean room or operating room with particles generated during the performance of the unclean work.

Another object of the invention is to provide a device to separate an area of a clean room where unclean work needs to be performed from the area where the manufacturing takes place, in order to isolate the contamination produced by unclean work from the clean room.

A further object of the invention is to provide a stable, easily assembled device to separate an area where unclean work needs to be performed from the rest of the clean room or operating room.

The present invention is related to a wall member that can be wedged between two surfaces. In one embodiment of the invention the wall member has an aluminum frame member attached to a wall panel. An interlocking channel is riveted to the frame member on one side of the frame member. The adjacent frame member has holes drilled in it and nuts are attached adjacent to the holes. A bolt is screwed down through each hole and the adjacent nuts, tightening the top of the wall member against one surface and the bolt against the other surface.

In a different embodiment of the invention an aluminum plate is placed below the bolt. The bolt is screwed down through each hole and the adjacent nuts to the aluminum plate, tightening the top of the wall member against the ceiling of the clean room and the bolt against the aluminum plate.

In another embodiment of the invention the wall members can be connected in series to separate the area where unclean work is taking place from the rest of the area. The wall members are connected in series by fitting the interlocking receiving channel of one wall member over a frame member of an adjacent wall member. The interlocking receiving channel slips snugly over the frame support of the adjacent frame member preventing air and debris particles from passing through. Each wall member can then be wedged between two non-adjacent surfaces of the area. A similar enclosure may be used on the opposite side of the clean room wall if a hole is being made in the wall and the room on the other side must also be kept clean.

In accordance with another aspect of the invention, the wall member is placed between the ceiling and the floor of a clean room, with the side of the wall member containing the bolts facing the floor. Plates are placed between the bolts and the floor. The bolts are screwed down through the nuts to the plate until the top of the wall member is tight against the ceiling, and the bolts are tight against the plates. This prevents air and debris particles from traveling above the wall member from the work area to the rest of the clean room. The vacuum is created by blower, which draws air through the holes in the floor of the clean room, this also draws the debris particles through the holes in the floor of the clean room as well as the air and prevents them from traveling from the work area to the clean room in the space between the wall member and the floor, which is approximately three-quarters to two inches.

The present invention is also directed toward an inexpensive, stable, and easily assembled and installed clean room wall. This is accomplished with a wall member that can be fastened with a fastener, such as studs, rivets, nails, bolts, adhesives, a track assembly, or any other fastener that will secure the wall member between two flat surfaces. The clean room wall is constructed by connecting the wall members in series and fastening them to two opposing flat surfaces of an area.

BRIEF DESCRIPTION OF THE DRAWINGS

For the purpose of illustrating the invention, there are shown in the drawings several embodiments which are presently preferred, it being understood, however, that this invention is not limited to the precise arrangements and instrumentalities shown.

DESCRIPTION OF THE INVENTION

Figure 2:
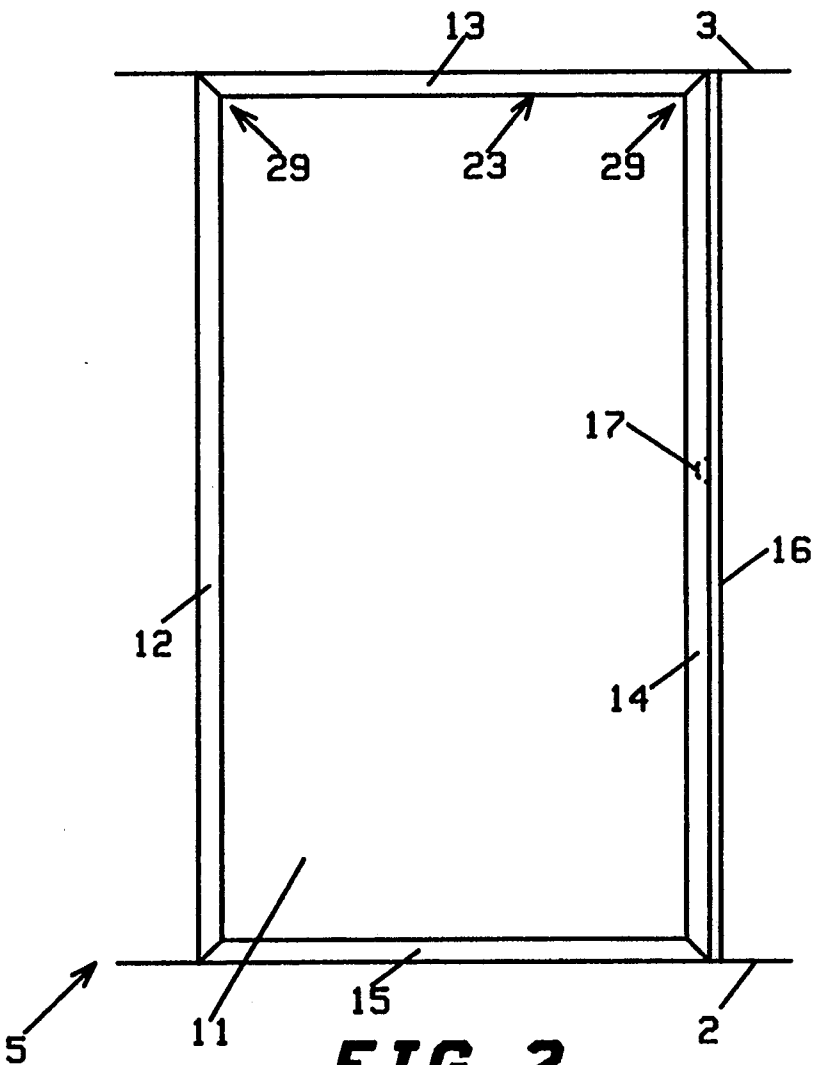
FIG. 2 shows a front view of another embodiment of the present invention.
Figure 1:
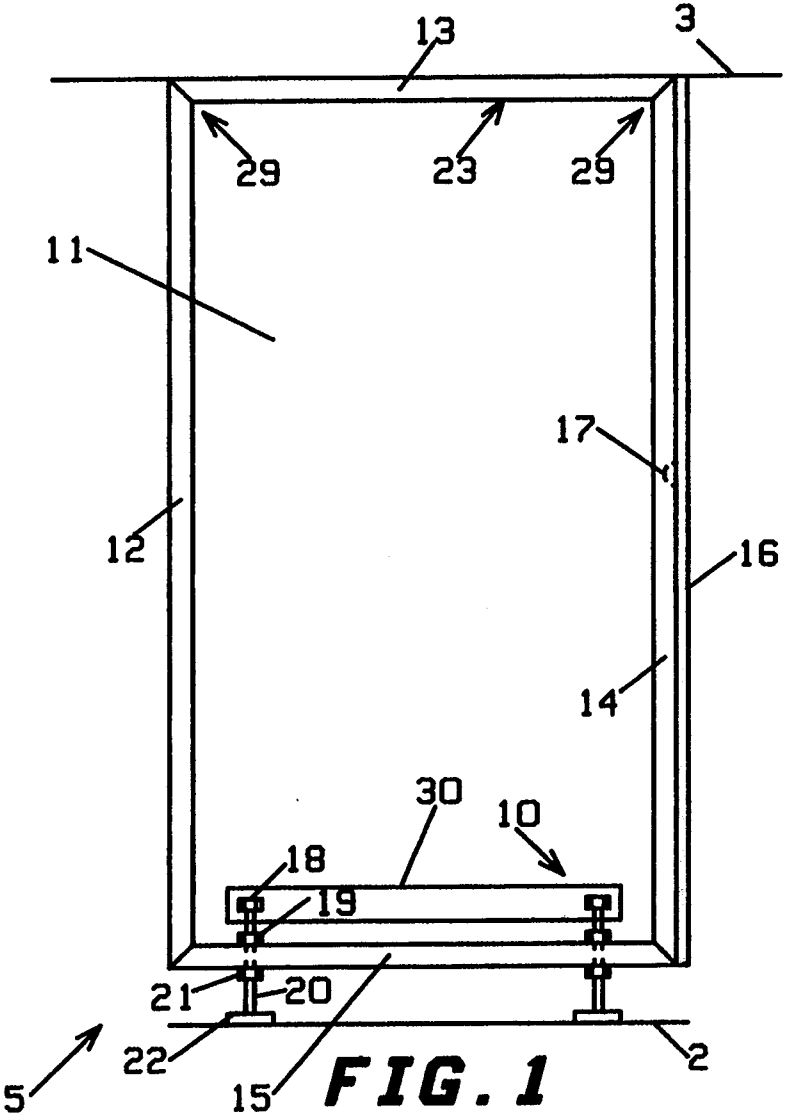
FIG. 1 is a front view of one embodiment of the present invention.

Referring now to the drawings, wherein like numerals indicate like elements, there is shown in FIG. 1 one embodiment of a wall member 5. The embodiment of the wall member 5 shown in FIG. 1 is to be used constructing a portable clean room wall. FIG. 2 shows another embodiment of a wall member 5, and this embodiment is to be used in constructing a permanent clean room wall. Referring to FIG. 1 and FIG. 2. Wall member 5 includes a panel 11. .The preferred width of the panel 11 is about three feet eight and one-half inches. The preferred length for the portable wall member 5, shown in FIG. 1, is the distance from the ceiling 3 to the floor 2 of the clean room minus from about four to seven inches, and the preferred length for the permanent wall member 5, shown in FIG. 2, is the distance from the ceiling 3 to the floor 2 of the clean room.

Suitable material for the panel 11 includes any material which does not flake or produce dust, such as plexiglass, aluminum or stainless steel. Alucobond, TM manufactured by Alucobond, is also suitable. The advantage of using alucobond TM is that it is not see-through. A panel that is not see-through prevents the unclean work, as well as piping or wiring that can be conducted through the wall member, to be seen from the clean room, producing a more aesthetic pleasing look. When weighed with the additional cost of using alucobond TM instead of the other above mentioned material, alucobond TM is preferred when the wall members are to remain in place for an extended period of time or when the wall members are to be used in the permanent wall.

The panel 11 is surrounded on each side by frame members 12, 13, 14, and 15, forming a frame around the panel. The panel is sealed to the frame members 12, 13, 14, and 15 by a bead of caulk 23. Silicone caulk has been found suitable. The panel fits into a groove in the frame members 12, 13, 14, and 15 located about one-quarter of an inch from the edge of the frame. Aluminum Products Inc.'s two inch by two inch patio frame member for use with flat spline has been found suitable. The preferred length of the top and bottom frame members 13, and 15 is four feet on the side furthest from the panel 11 and three feet eight inches on the side closest to the panel 11. In the wall member 5 shown in FIG. 1, two wedging devices 10 are placed in the bottom frame member 15, as will be described later. The length of the right and left frame members 12, and 14 on the side furthest from the panel is the distance from the ceiling 3 to the floor 2 of the clean room minus from about three-quarters to two inches, and the length on the side closest to the panel 11 is four inches less than on the side furthest from the panel 11. In the wall member 5 shown in FIG. 2, the length of the right and left frame members 12, and 14 on the side furthest from the panel is the distance from the ceiling 3 to the floor 2 of the clean room, and the length on the side closest to the panel 11 is the distance from the ceiling 3 to the floor of the clean room minus four inches. Of course, the above dimensions can be adjusted to any convenient size.

Figure 3:
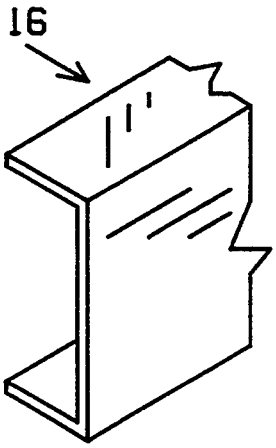
FIG. 3 shows a perspective view of the interlocking receiving channel of the present invention.
Figure 4:
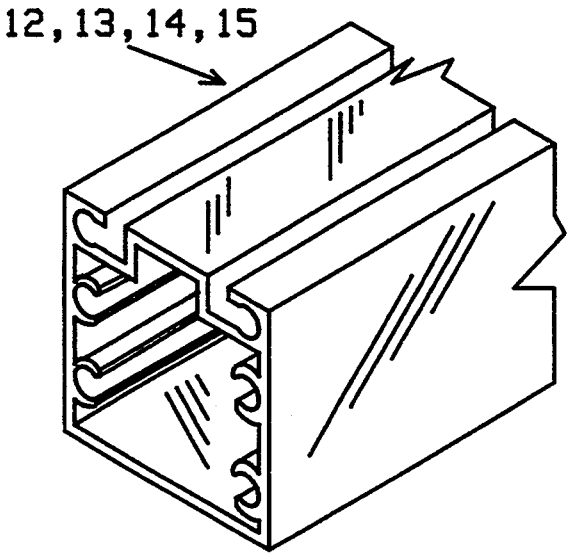
FIG. 4 shows a perspective view of the frame members of the present invention.

Referring again to FIG. 1 and FIG. 2, in an embodiment of the invention a rivet 17 attaches an interlocking receiving channel 16 to the outside of the right frame member 14. A suitable interlocking receiving channel is Aluminum Products Inc.'s interlocking receiving channel. If desired the interlocking receiving channel 16 can be sealed to the frame member 14 with a bead of caulk 23, such as silicone caulk. In one embodiment of the invention, as shown in FIG. 1, the interlocking receiving channel 16 is attached to the side of the right frame member 14 furthest from the panel 11, to form a wall member 5. In another embodiment of the invention the interlocking receiving channel 16 is attached to the side of the right frame member 14 adjacent to the side containing the groove into which the panel 11 fits into, to form a corner wall member 6. Except for the location of the interlocking receiving channel 16, the corner wall member 6 is constructed in the exact same way as wall member 5. FIG. 3 shows a perspective view of the interlocking receiving channel 16, and FIG. 4 shows a perspective view of the frame members 12, 13, 14, and 15.

Figure 5:
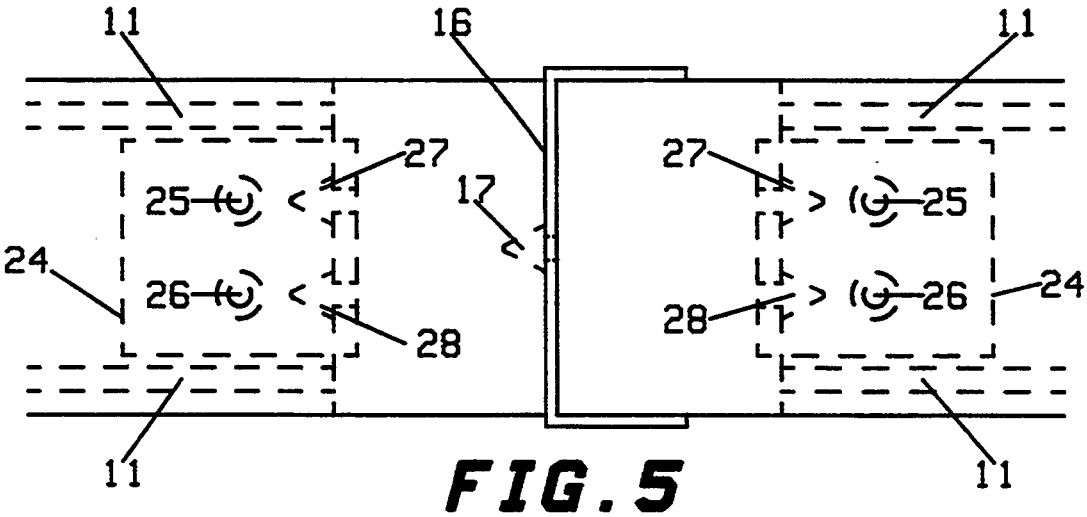
FIG. 5 shows a top view of one embodiment of the coupling means of the present invention.

Referring to FIG. 1, FIG. 2, and FIG. 5, the frame members 12, 13, 14, and 15 are connected at the ends with an L shaped clip 24 to form the corners 29 of the frame surrounding the panel 11. The L shaped clip 24 is placed inside two adjacent frame members at the place where the two adjacent frame members form the corner 29 of the frame. One side of the L shaped clip 24 is attached with two rivets 25 and 26 to one of the two adjacent frame members and the other side of the L shaped clip 24 is attached with two rivets 27 and 28 to the other adjacent frame member. The corner 29 can be sealed with a bead of caulk 23, such as silicone caulk.

In another embodiment of the invention a second panel 11 can be attached to the frame. The second panel fits into the second groove in *the frame members 12, 13, 14, and 15. The second groove is on the inside of the frame, about one-quarter of an inch from the edge of the frame opposite the edge of the frame to which the first panel is closest to. The addition of a second panel allows piping and wiring needed in the clean room to be conducted through the wall member, by placing it between the two panels 11 of a wall member 5, concealing the piping and wiring. This prevents the area on either side of the wall member 5 from appearing as though it is under construction due to the exposed piping or wiring.

The wall member 5 that is to be used in the portable wall, shown in FIG. 1, contains two wedging device. One embodiment of the wedging device, to be described later contains bolts attached one frame member 15 of the wall member 5. The second panel 11 of the wall member that contain this embodiment of the wedging device has an opening 30 close to the bolt 18, to allow access to the bolt 18 in order to tighten it.

Referring now to FIG. 2 the wall member 5 that is to be used in the permanent wall can be secured in place using means other than a wedging device. The wall members 5 that are to be used in the permanent wall are attached to the ceiling 3 and floor 2 of a clean room with a fastener. Suitable fasteners include: bolts, nails, adhesives, track assembly systems, rivets, and studs, with aluminum studs being the preferred fastener. Although some fasteners have been enumerated, any fastener that secures the wall panel 5 between the ceiling 3 and floor 2 of the clean room is suitable, and many other fastening means will occur to those skilled in the art.

FIG. 5 shows how a first wall member can be connected to a second wall member. The first wall member can be either a wall member 5 or a corner wall member 6, although, for ease of demonstration only a wall member 5 is shown in FIG. 5. The second wall member can also be either a wall member 5 or a corner wall member 6. In order to connect a first wall member to second wall member, the second wall member must be placed so that the side of left frame member 12 of the second wall member furthest from the panel 11 is facing the front of the interlocking receiving channel 16 of the first wall member. The interlocking receiving channel 16 of the first wall member is slipped over the left frame member 12 of the second wall member. The sides of the interlocking receiving channel 16 of the first wall member fit around the sides adjacent to the side furthest from the panel 11 of the left frame member 12 of the second wall member.

Figure 6:
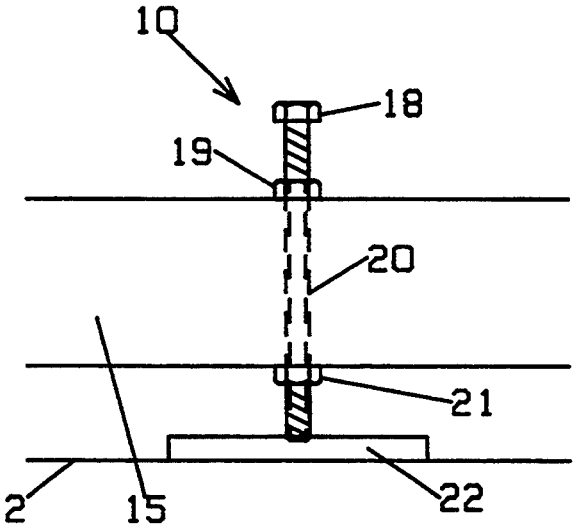
FIG. 6 shows a front view of one embodiment of the wedging device of the present invention.

FIG. 6 shows one embodiment of the wedging device, 10. A hole 20 is made in the bottom frame member 15. Coated nuts 19 and 21 are mounted adjacent to the hole 20. A one-half by four inch coated bolt 18 is screwed through the hole 20 and nuts 19, and 21. Any coating that does not flake or produce dust is suitable. Zinc, or cadium, coating is preferred. A plate 22 is placed under the bolt 18 so that, as will be discussed later, the bolt 18 can be tightened against the plate 22. This distributes the load across the floor 2, which is typically grid-like to permit air to flow downward through the floor 2. The preferred material for the plate 22 is aluminum.

In another embodiment of the wedging device 10 the hole 20 drilled in the bottom frame member 15 is threaded. A bolt 18 is screwed through the hole. A plate 22 is placed under the bolt 18 so that, as will be discussed later, the bolt 18 can be tightened against the plate 22. The preferred material for the plate 22 is aluminum. The two embodiments listed above are just two variants of the wedging device and other wedging devices will occur to those skilled in the art.

Figure 7:
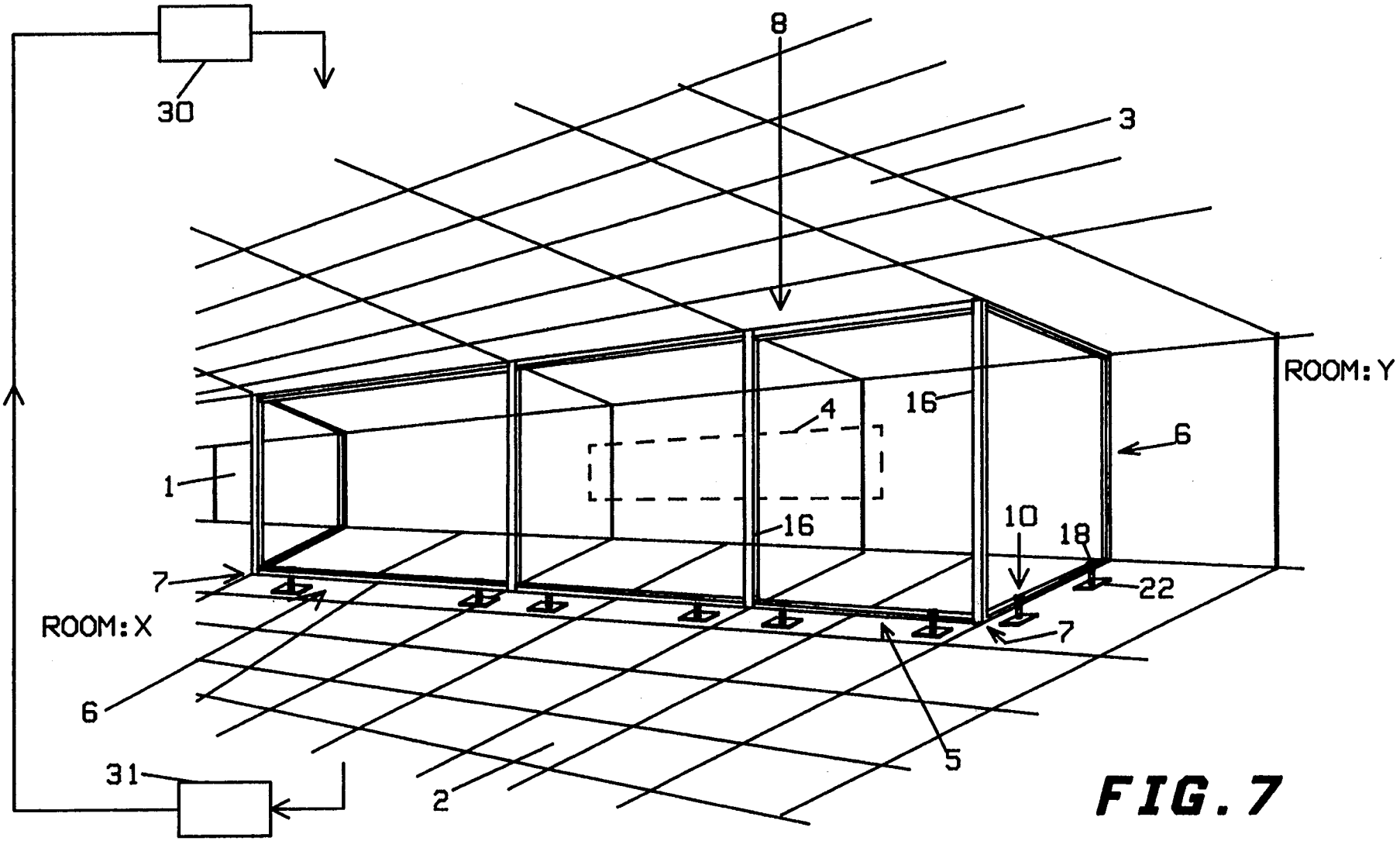
FIG. 7 shows a perspective view of an embodiment of the present invention.

FIG. 7 shows the portable wall during use. Suppose that rooms X and Y are divided by partition wall 1 and an opening, such as a drilled hole, is required in area 4, shown by dotted lines. Wall members 5 and corner wall members 6 are connected in series and tightened in to surround area 4 in room X, where the unclean work is to be done, to separate area 4 from the rest of room X. If both rooms are to be kept clean then the wall members 5 and corner wall members 6 are also connected in series and tightened in to surround area 4 in room Y to separate area 4 from the rest of room Y.

A permanent wall is very similar to the portable wall during use. Suppose that rooms X is to be separated into two rooms. Wall members 5 and corner wall members 6 are connected in series and fastened to the ceiling 3 and the floor 2 of the clean room.

Still referring FIG. 7, the arrangement of the wall members when they are connected will be described. The wall members of the portable clean room wall and of the permanent clean room wall is are connected together in the same way. A wall member 5 is placed tightly against the permanent wall 1. To achieve the desired length of the side of the portable wall 8 another wall member 5 is placed adjacent to the preceding wall member 5, and connected, as described earlier, until the side of the portable wall 8 is four feet less than the desired length. Then, a corner wall member 6 is connected to the last wall member 5 in the series. Another wall member 5 is placed in front of the corner wall member 6 and connected, as describer earlier, forming a corner 7. Another wall member 5 is again placed adjacent to the just connected wall member 5 and connected. This process is continued until side of portable wall being put together is four feet short of the desired length, and a corner wall member 6 is placed adjacent to and connected to the last wall member 5 in the series. Another wall member 5 is placed in front of the corner wall member 6 and connected. Other wall members 5, are then placed and connected in series until this side of the portable wall 8 is long enough to reach the permanent wall of the clean room 1. The interlocking receiving channel 16 of the last wall member 5 is removed before it is put in place, to insure that wall member 5 can be placed tightly against the wall of the clean room 1. If the desired lengths of any side of the portable wall 8 is four feet or less, a corner wall member is used instead of a regular wall member 5; either right next to the wall of the clean room 1, or in front of another corner wall member 6. If there is an obstruction, such as a lighting fixture, pipe, or column where a wall member 5 or a corner wall member 6 is to be placed, a notch the shape and size of the obstruction can be cut out of the wall member 5 or corner wall member 6 to allow the wall member 5 or corner wall member 6 to fit around the obstruction. The notch is cut as close as possible to the shape and size of the obstruction to leave as little space as possible for air to pass through between the wall member 5 or corner wall member 6 and the obstruction.

The portable clean room wall is then tightened into place. The bolts 18 in each wall member 5 or corner wall member 6 are tightened until the top of the wall member 5 or corner wall member 6 is tight against the ceiling of the clean room 3, and the bolts are tight against the plates 22 on the floor of the clean room. This leaves a space from approximately three-quarters to two inches between the bottom of the wall members 5 and corner wall members 6 and the floor 2. A vacuum removes the debris particles through holes in the floor 2 of the clean room. The vacuum is created by a blower 30 which draws air through the floor 2 of the clean room and passes it through a filter 31 before returning the air to the clean room. Any debris particles generated by the unclean work is removed from below the wall members by the vacuum source through the holes in the floor 2 before the debris particles can travel from the work area now enclosed by the portable wall to the rest of the clean room.

In a different aspect of the invention, a plurality of wall members can be connected together as described above to form a portable wall 8, or just one side of a portable wall. The portable wall 8, or side of a portable wall can be oriented for the frame members 15 containing the bolts to be facing one surface in an area, and the frame members 13 is facing another surface in an area. The two surfaces do not have to be the floor and ceiling of a room. The bolts 18 in the wall member 5 are tightened until the top of the wall member 5 is tight against one surface of the room, and the bolts 18 are tight against the other surface.

While specific embodiments of the invention have been shown and disclosed, it is to be understood that numerous changes and modifications may be made by those skilled in the art without departing from the scope and intent of the invention. For example, the embodiment shown in FIG. 7 can be modified adding another portable wall in room Y if both rooms must be kept clean. Additionally, the particular wedging device and connector may be modified; including by attaching the interlocking receiving channel 16 to the left frame member 12 instead of to the right frame member 14 as shown in FIG. 1 and FIG. 5, and then fitting it over right frame member 14 instead of the left frame member 12, moreover the wedging device can be modified to be for example a cam operated system. Also, the dimensions of the invention can be altered to ease installation of the invention, and to adjust the invention to the space in which the unclean work is performed. Furthermore, the invention can be used with any tools utilized in performing unclean work, including cutting, drilling, welding and punching tools.

Thus it is apparent that in accordance with the present invention, an apparatus that fully satisfies the objectives, aims, and advantages is set forth above. While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications, and variations as fall within the scope of the appended claims.

What is claimed is:

1. A wall member for use in a clean room having a ceiling and floor, said clean room including an air handling system with an exhaust at the ceiling and an intake at the floor, comprising:

a right, left, top and bottom frame member, each having a first and a second groove, said frame members attached to form a rectangular frame having four corners and adapted to be disposed in said clean room extending from said ceiling to substantially to, but not to, said floor so as to allow said exhaust to move air below said bottom frame member but not above said top from member;

a first non-dust producing panel attached to said rectangular frame by being fit into said first groove;

a second non-dust producing panel attached to said rectangular frame by being fit into said second groove, said first and second non-dust producing panels defining a space therebetween allowing pipes or wires to be conducted therethrough;

said bottom frame member having first and second holes;

two nuts disposed one at a top and one at a bottom of each hole;

a bolt screwed through each hole and the two nuts disposed one at the top and one at the bottom of each hole;

a metal plate disposed at a bottom of each bolt and adapted to be in contact with the floor; and one of said panels including an opening that allows access to said bolts.

* * * * *